US007040353B2

(12) United States Patent
Covelli

(10) Patent No.: US 7,040,353 B2
(45) Date of Patent: May 9, 2006

(54) WEFT YARN DEFLECTION BRAKE AND METHOD FOR CONTROLLING THE WEFT INSERTION INTO WEAVING MACHINE

(75) Inventor: Marco Covelli, Occhieppo Inferiore (IT)

(73) Assignee: Iropa AG, Baar (CH)

( * ) Notice: Subject to any disclaimer, the term of this patent is extended or adjusted under 35 U.S.C. 154(b) by 159 days.

(21) Appl. No.: 10/343,376

(22) PCT Filed: Jul. 31, 2001

(86) PCT No.: PCT/EP01/08867

§ 371 (c)(1),
(2), (4) Date: Aug. 6, 2003

(87) PCT Pub. No.: WO02/10493

PCT Pub. Date: Feb. 7, 2002

(65) Prior Publication Data

US 2004/0025957 A1 Feb. 12, 2004

(30) Foreign Application Priority Data

Aug. 2, 2000 (SE) ..... 0002813

(51) Int. Cl.
*D03D 47/34* (2006.01)

(52) U.S. Cl. ..... 139/194; 139/452

(58) Field of Classification Search ..... 139/194, 139/453; 242/421
See application file for complete search history.

(56) References Cited

U.S. PATENT DOCUMENTS

| | | | | |
|---|---|---|---|---|
| 4,962,976 | A | 10/1990 | Takahashi et al. | |
| 5,417,251 | A | 5/1995 | Josefsson et al. | |
| 5,462,094 | A | 10/1995 | Josefsson et al. | |
| 6,539,982 | B1 * | 4/2003 | De Swart | 139/194 |

FOREIGN PATENT DOCUMENTS

| | | | | |
|---|---|---|---|---|
| DE | 41 31 656 | | 3/1993 | |
| DE | 41 31 652 | | 4/1993 | |
| EP | 0 239 055 | | 9/1987 | |
| NL | 1011171 | * | 8/2000 | 139/194 |
| WO | WO 98/05812 | | 2/1998 | |
| WO | WO 00/44970 | | 8/2000 | |

* cited by examiner

*Primary Examiner*—Peter Nerbun
(74) *Attorney, Agent, or Firm*—Flynn, Thiel, Boutell & Tanis, P.C.

(57) ABSTRACT

A weft yarn deflection brake including a braking element 5 which can be adjusted in timed fashion and by its variable braking force, a drive motor 6 for said braking element and a control device CU connected with said drive motor 6 is equipped by a position detection means E associated to said braking element 5. Said position detecting means E is connected to an adjustment means 9 for functional parameters of the deflection brake. During operation functional parameters as e.g. the braking force and the time of the activation of the deflection brake are varied adaptively in order to assure a performance of the deflection brake which is deemed to be optimal for the insertion system. At selected points in time known target positions of the braking element are set and compared with the actual positions. In case that deviations are detected a respective functional parameter is varied.

19 Claims, 3 Drawing Sheets

Tension

Position max

I+
I-stop
cut
off

WEFT YARN DEFLECTION BRAKE AND METHOD FOR CONTROLLING THE WEFT INSERTION INTO WEAVING MACHINE

FIELD OF THE INVENTION

The invention relates to a weft yarn deflection brake including a braking element located within the weft yarn path which is positionally adjustable and adjustable with respect to braking force between a braking position and a passive position. The invention also relates to a method for controlling the weft-yarn insertion into a weaving machine.

BACKGROUND OF THE INVENTION

Controlled deflection brakes according to WO 98/05812, U.S. Pat. No. 4,962,976 A and EP 0 239 055 A are used in insertion systems of different weaving machine types, e.g. jet weaving machines, gripper or rapier weaving machines, etc., for controlling the weft yarn insertion in view of a minimum quota of yarn breakages or fabric faults, respectively. The weft yarn is deflected during braking by means of a pivotable or lineally moveable braking element which is adjusted between a passive position without any braking effect and a deflecting braking position.

WO 98/05812 discloses a selection of braking functions of a deflection brake for a jet weaving machine. During a first part of an insertion, the rotatable braking element remains in its passive position without influence on the weft yarn flight. In the final part of the insertion and when an unavoidable whiplash effect caused by the activation of the stopping device of the feeder would cause a yarn tension peak, the braking element is adjusted into its braking position to attenuate the yarn tension peak. The braking force first is adjusted such that the braking element resiliently is brought back by the yarn from its braking position in a direction towards its passive position in order to dissipate energy. After this point in time, the braking force is decreased such that during the subsequent weft yarn beat up action of the reed, the yarn length stored in the deflection brake is released and the yarn is kept stretched out. In this situation, the braking element at least substantially returns in its passive position before the weft yarn is cut. Since the cut weft yarn is loaded by a holding force generated by the insertion nozzle, the decreased braking force just should suffice to again adjust the braking element into its braking position and to pull back the free weft yarn tip into the insertion nozzle. Then, for the next insertion the braking element is adjusted back into its passive position. In a gripper or rapier weaving machine different braking functions are needed than in a jet weaving machine. Basically, it can be said for a controlled deflection brake that its performance is the better the more accurately at least two functional parameters are adapted to the weaving operation conditions, namely the braking force and the point in time of the brake activation. WO 98/05812 discloses to time or regulate the activation point in time of the deflection brake and its braking force, respectively, that the curve of the supplied current is matched with conditions or parameters depending on the yarn quality, the weaving machine type and the mode of operation of the system, and that the response behaviour of the deflection brake and certain delay times are considered. However, it is not explained how such regulations are made. In practice, such parameters are adjusted with the help of a yarn tension measuring device arranged in the yarn path between the deflection brake and the insertion nozzle. A tensiometer provided in the yarn path for such purposes, however, undesirably modifies the yarn flying time, since eyelets and the additional deflection angles of the tensiometer disturb the yarn flight. A tensiometer cannot be implemented permanently, because it is too costly and too sensitive and disturbs the insertion cycles and yarn threading procedures. The method employed in practice, furthermore, is a coarse trial and error process leading to a compromise adjustment of the deflection brake performance only. It does not does not allow an automatic and real time adjustment depending on the actual operation conditions.

It is an object of the invention to provide a deflection brake and a method, as mentioned above, by means of which the yarn insertion is optimised with optimal short weft yarn flight times and a small quota of yarn breakages or fabric faults. Part of the object is an automatic adaptation of the following functional parameters to the actual operation: time of actuation of the deflection brake and the braking force.

Said object can be achieved in a deflection brake having a position detection assembly connected to an adjusting device which correlates with functional parameters of the deflection brake.

The core of the invention is the recognition that the position of the braking element and/or the movement behaviour of the braking element at significant points in time or during significant time durations of an insertion by nature is delivering information on the performance of the deflection brake and is offering a possibility for a simple optimisation of the adjustments, without the necessity of mechanical interference by measuring instruments which disturb the yarn flight. An optimisation of the adjustment of the brake on the basis of the respective position of the braking element leads to optimally short weft yarn flight times, to minimum variations of the weft yarn flight times, to a minimisation of the energy consumption of the deflection brake and of other components of the insertion system consuming energy and the like.

A "point in time or time duration" can be expressed by a certain angle value or angle range of the rotation e.g. of the main shaft of the weaving machine as well. The term "braking force" is equal with the actuating force or the braking torque of the braking element or its drive motor, respectively.

The position detection means of the deflection brake generates information of the initial position and/or the momentary movement behaviour of the braking element by comparison with a target position and allows an adaptive optimisation of the functional parameters by the adjustment device. No measuring instruments are needed which could mechanically disturb the yarn flight. The performance of the deflection brake is checked exactly and varied at the location where during operation the deflection brake is engaging the weft yarn.

According to the method of the invention, target positions of the braking element are set beforehand for selected times during an insertion. By means of the respective actual detected positions of the braking element detected during the insertion, differences between the target positions and the actual positions can be determined and can be converted into correction signals. Based on correction signals, the functional parameters are adjusted. This leads to an adaptive optimisation control of the performance of the deflection brake for an optimal weft yarn insertion.

The position detection means should have at least one position indicator moving with the braking element and a stationary position detector, both coacting without mechanical influence on the weft yarn, while providing the required information.

A structurally simple solution incorporates a permanent magnet at the braking element. The magnetic field of the magnet is scanned by an analogously operating Hall effect sensor. In this case, at each selected time the position of the braking element will be known. Alternatively, the movement behaviour of the braking element can be determined within a selected time duration. Said information is used for the optimisation.

Expediently, the control device is in signal receiving connection with one or several components of the weft yarn insertion system, which components are apt to give additional information for the selected times.

According to the method, by using the position information of the braking element and in case that the deviations from the target positions are detected, the mentioned functional parameters are varied in view of a duration of the weft yarn flight time which is an optimum for the weaving machine.

Particularly in a jet weaving machine the mentioned functional parameters of the deflection brake are the timing of the brake actuation or de-actuation and/or the braking force. This should not exclude varying other functional parameters, e.g. in other types of weaving machines.

Selected times or points in time can be determined by means of winding unspooling signals of a sensor of the feeder which signals follow the yarn during the course of the insertion.

Other relevant points in time correlate with the occurrence of activating and/or de-activating signals of the weft yarn stop device of the feeder.

Even the occurrence of a weft yarn cut signal represents a relevant point in time for a check of the function of the deflection brake.

Basically, and according to the method the inherent response behaviour of the deflection brake for activating and de-activating signals or braking force variation signals ought to be considered.

According to a variant of the method it is determined whether or not the deflection brake is operating as intended at the point in time of the unavoidable yarn tension peak initiated by the engaging stopping device of the feeder. If the braking element at this point in time still remains in the braking position, even though it should have left the braking position to attenuate the yarn tension peak, the braking force is decreased such that the deflection brake will have a better performance during a later insertion.

Furthermore, it is checked according to the method at the point in time of the yarn tension peak whether or not the braking element carries out oscillating position changes during a predetermined time duration, because this indicates a too weak braking force. If yes, the braking force is increased to achieve a better performance during a later insertion.

If according to the method it is determined that the braking element has not yet reached the target braking position at the point in time of the yarn tension peak, this indicates that the deflection brake had been activated too late. Then the point in time for the activation is adjusted to "earlier", in order to create improved conditions for later insertions.

Furthermore, according to the method a detected braking position of the braking element prior to the point in time of the yarn tension peak indicates that the deflection brake has been activated too early and would brake the weft yarn too long (prolongation of the weft yarn flight time). This detection result is used to adjust of the point in time of the brake actuation to "later" to achieve a better function for a later insertion.

In case that the braking element has not moved into or at least close to the target passive position at the point in time of the cut signal, this indicates a momentary braking force which is too high, thereby jeopardising the needed pull back function. As a consequence, the braking force then will be decreased.

After occurrence of the cut signal, the holding force of the insertion nozzle is still acting on the cut weft yarn. The braking force then should be just enough to overcome the holding force. By respectively increasing and decreasing the braking force in depending upon whether or not the braking element then reaches the target braking position too rapidly or not at all, the braking force is adjusted and adapted to the momentary holding force of the insertion nozzle. By carrying out such steps, both the holding force and the braking force can be adjusted optimally low in order to save energy for the actuation of the deflection brake and fluidic energy for the insertion nozzle.

The detection of the actual positions of the braking element or the movement behaviour of the braking element, comparisons with the target positions, derivations of correction signals and adjustments of the functional parameters are carried out substantially in real time so that even with very high yarn speeds and high insertion frequencies of modern weaving machines a permanent adaptive adjustment of optimum operation conditions of the deflection brake is achieved without additional mechanical yarn disturbance.

The above described method variants are only a selection of a greater plurality of possibilities, e.g. appropriate for air jet weaving machines, even though e.g. in other weaving machine types there might exist other points in time or angles during an insertion at which the position or the movement behaviour of the braking element can give clear information on the performance of the deflection brake to adaptively optimise its performance.

BRIEF DESCRIPTION OF THE DRAWINGS

An embodiment of the invention is described with reference to the drawings in which.

DETAILED DESCRIPTION

Figure 1:
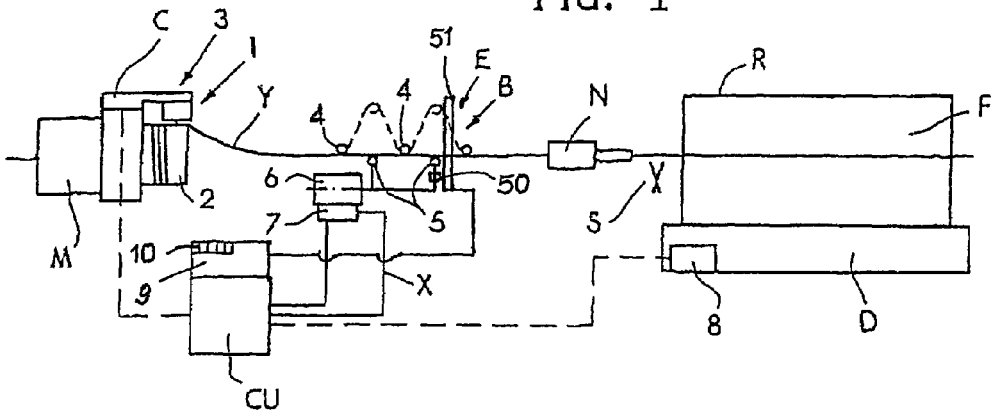
FIG. 1 schematically depicts a weft yarn insertion system of a jet weaving machine.

The weft yarn insertion system in FIG. 1 illustrates the conditions in a jet weaving machine, e.g. in an air jet weaving machine. The invention is not limited to jet weaving machines but also can be employed for other types of weaving machines, e.g. for gripper weaving machines or projectile weaving machines.

The weft yarn insertion system in FIG. 1 includes a weaving machine D having a weaving shed F and a reed R, at least one feeder M. The feeder M is a so-called measuring feeder equipped with a storage drum 2, a stopping device 1, at least one signal generating sensor 3 for withdrawn yarn windings. A controlled deflection brake B, an insertion nozzle N, and a cutting device S are provided in the yarn path between the feeder M and the weaving shed F.

The deflection brake B has stationary deflection points 4 at one side of the yarn path and a moveable braking element 5 with deflection elements (in the shown embodiments two deflection elements) which can be adjusted by a drive motor 6 transverse to the yarn path to move between the stationary deflection points out of a passive position (shown in full lines) into a braking position of the braking element 5 (shown in dotted lines). Drive motor 6 e.g. is a quick responding permanent magnet motor connected to a current regulation circuit 7 and a control device CU. For example, by means of control device CU a reduction control signal X can be supplied to current regulating circuit 7 to lower the active braking force to a reduced braking force level, e.g. by reducing the driving current or the driving voltage. Control device CU can be connected to a control unit C of feeder M and/or to a control system 8 of weaving machine D.

A position detection device E is provided for braking element 5. For example, at control device CU an adjustment device 9 for functional parameters of the deflection brake B is provided, together with a setting device 10 for target positions of braking element 5 at selected points in time. Said position detecting device comprises, e.g., a permanent magnet 50 for common movement with braking element 5, and a stationary analogously operating Hall effect sensor 51. Sensor 51 generates signals representing the momentary position of the braking element by reading the intensity of the magnetic field of the permanent magnet 50. The signals output are to control device CU or the adjustment device 9, respectively. The adjustment device 9 includes a position comparison and evaluation section and an adjustment circuit for certain functional parameters of the deflection brake B, namely e.g. the braking force and the point in time for activating said brake.

Instead of a sensor detecting the entire movement of the braking element in an analogous fashion, position indicators for e.g. only two positions could be provided.

Basic Function:

Prior to an insertion, storage drum 2 is carrying a number of yarn windings covering at least the yarn consumption of the upcoming insertion. Stopping device 1 is engaged and blocks the weft yarn Y. Weft yarn Y extends through the deflection brake B (in its passive position) to insertion nozzle N pulling the yarn tip with a predetermined holding force. As soon as the weaving machine opens the shed F and outputs a trig signal to control device CU and control unit C the pressure for insertion nozzle N is increased. At a point in time within a 360° rotation angle of the main shaft of the weaving machine, said point being optimally determined for the respective weaving machine specification, stopping device 1 is moved into its release position. Insertion nozzle N shoots the then released weft yarn Y into the shed F while windings consequently are unspooled from storage drum 2. Sensor 3 generates a passing signal for each unspooled winding and informs control unit C and also control device CU, respectively. Deflection brake B still is not activated.

As soon as control unit C pre-calculates that the yarn length needed for the insertion will be withdrawn soon, an activating signal is output to adjust stopping device 1 into the stopping position. If the yarn was stopped by the stopping device 1 only, a whiplash effect could occur accompanied by a significant yarn tension peak with the danger of a yarn breakage. For that reason deflection brake B is timely activated, e.g. with the signals of sensor 3 at or after the activation of stopping device 1 at a point in time selected such that braking element 5 just in time reaches its braking position when said yarn tension peak would occur. By deflection of the weft yarn and friction forces kinetic energy of the weft yarn then at least is dissipated by the brake a significant amount. During this braking operation the braking element 5 is resiliently displaced by the yarn out of its braking position, because the braking force is adjusted such that the braking element will be resiliently moved back by the force of the weft yarn from the braking position in the direction towards the passive position. Thereafter, it returns into the braking position by the still acting braking force.

In this fashion, kinetic energy of the yarn is dissipated so that only an attenuated yarn tension peak occurs. For the final part of the insertion then a braking force with a reduced value is selected so that during yarn beat up by the reed a consequent yarn tension increase will displace the braking element from the meanwhile again achieved braking position at least close to or to the passive position, until the cut signal is transmitted to cutting device S. During this operation the yarn length stored temporarily in the deflection brake is released.

The fluid power to the insertion nozzle N now is reduced. Because of the cut, the yarn tension drops to the level of the holding force of the nozzle N so that braking element 5 with the reduced braking force just is able to again reach the braking position and pulls back the yarn tip into insertion nozzle N. After a predetermined time duration later motor 6 is controlled in reverse direction to return braking element 5 into its passive position for the next insertion.

Among others, two main functional parameters are varied in the deflection brake, namely the braking force and the point in time of actuation (or deactivation). Said functional parameters are decisive for the optimum performance of the deflection brake in view of optimally short weft yarn flying time and minimum energy consumption.

According to the invention said functional parameters of the deflection brake are varied automatically and actively and in real time in order to achieve optimum yarn control during operation. For the adjustments made the recognition is considered that the braking element in case of optimised performance has to be at known target positions at certain points in time or has to carry out a certain movement pattern. At least over the final part of an insertion at selected points in time the respective actual position of the braking element is detected and is compared to a respective target position. By comparison between the actual position and the target position, a deviation is detected and a correction signal is derived and used to vary said functional parameters such that for a later insertion the respective actual position at least substantially coincides with said target position. Then the deflection brake will operate optimally. This is explained by means of FIGS. 2 and 3.

Figures 2A, 2B, 2C, 2D, 2E, 2F:
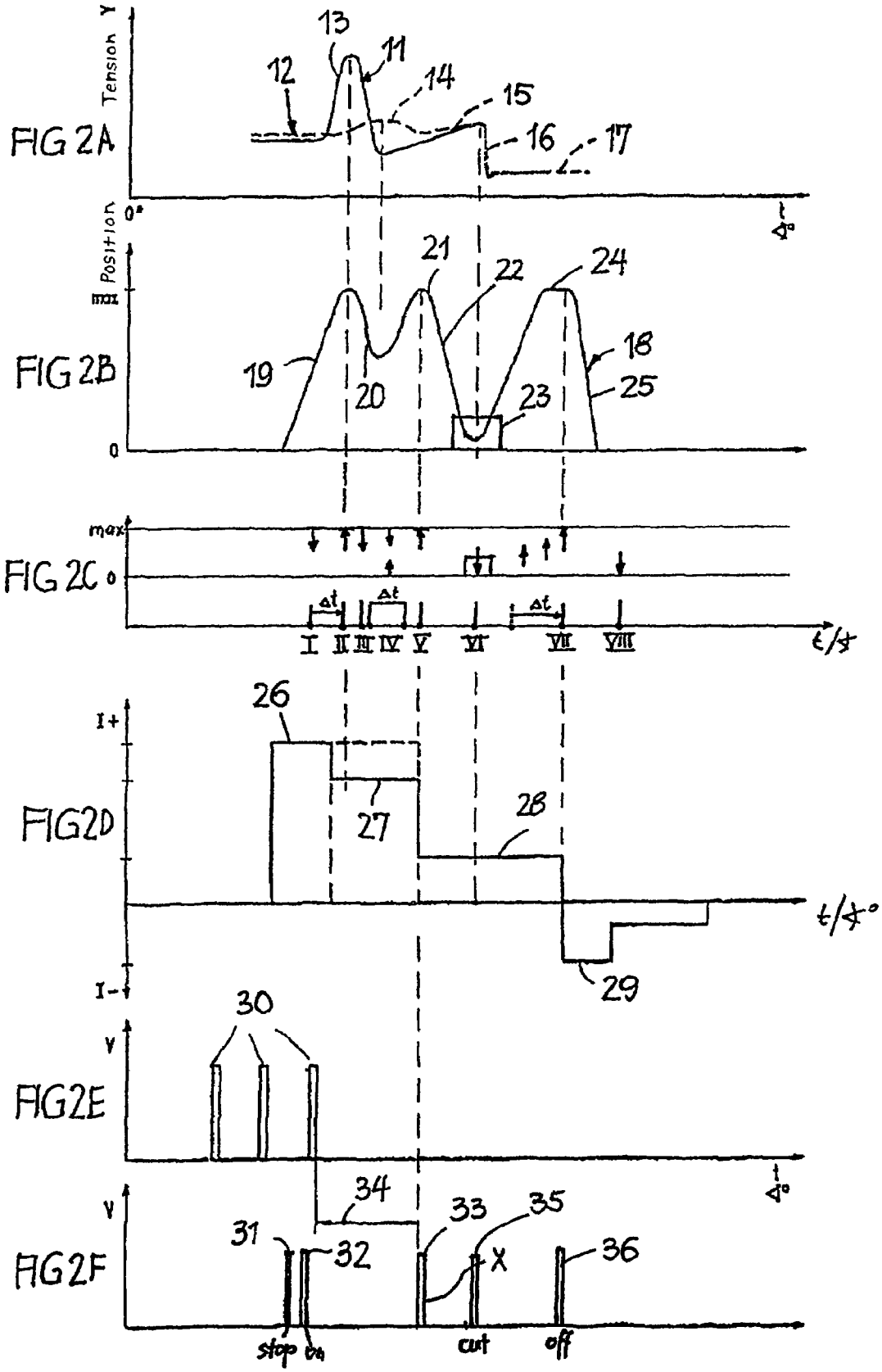
FIGS. 2A–2F comprise a group of diagrams, commonly associated to the final part of an insertion in the system of FIG. 1.

Six diagrams, FIGS. 2A–2F, are associated with the same angular range or time period, indicating important functions during the final part of an insertion. FIG. 2A illustrates by full line curve 11 the course of the yarn tension without operation of the deflection brake B and by dotted line curve 12 the course of the yarn tension achieved by optimum performance of the deflection brake B. FIG. 2B illustrates by curve 18 the movements of braking element 5 between its passive position and its braking position. FIG. 2C indicates relevant selected points in time or time durations I–VIII for the detection of the respective actual position of the braking element and also respective symbolically shown target positions. FIG. 2D represents the current supply curve of the drive motor. FIG. 2E indicates signals generated by sensor 3 of feeder M which signals can be used to pre-calculate or retrieve at least some of the points in time shown in FIG. 2C. Finally, FIG. 2F illustrates other occurring signals useful as references to select respective points in time in FIG. 2C.

In FIG. 2A the first relatively constant yarn tension of the theoretical full line curve 11 suddenly increases a known time period after the occurrence of stop signal 31 in FIG. 2F (for the stopping device 1). Curve section 13 depicts a high tension peak, if stopping device 1 alone abruptly stopped the rapidly flying weft yarn Y. After curve section 13, the yarn tension drops significantly prior to a further increase in curve section 15 (due to the beat up movement of the reed) and finally drops after the cutting step (cut signal 35 in FIG. 2F) in curve section 16 to a remaining holding tension according to horizontal curve section 17. The actual yarn tension course corresponds to dotted curve 12 when the deflection brake B is operating optimally. Within dotted curve 12, curve section 13 is replaced by a mild yarn tension peak 14. Also the tension increase in curve section 15 until the cut takes place is formed more moderately. After the cut the yarn tension in curve section 17 remains corresponding to the holding force. Dotted curve 12 is achieved by the movement of the braking element 5 corresponding to curve 18 shown in FIG. 2B.

With activating signal "ON" 32 in FIG. 2F, braking element 5 is brought to move along curve section 19 from its passive position into the braking position. It reaches the braking position just shortly prior to or in synchronisation with the occurrence of the high yarn tension peak expected according to curve section 13 in FIG. 2A. Said movement is controlled by a starting current indicated in curve section 26 in FIG. 2D, which starting current either is maintained later on (dotted curve section) or which is reduced to a lower current following curve section 27. The current value represented by curve section 27 is selected such that braking element 5 will be displaced back by the yarn along curve section 20 in FIG. 2B towards its passive position. In this way energy is dissipated (mild yarn tension peak in curve section 14). Due to the still active braking force, then braking element 5 again moves into its braking position in curve section 21.

At point in time X, a reduction signal 33 (in FIG. 2F) is generated reducing the current and in turn reducing the braking force in curve section 28 in FIG. 2D. Said reduced braking force allows the yarn tension increase in curve section 15 in FIG. 2A (caused by the beat up of the reed R) to bring braking element 5 in curve section 22 in FIG. 2B into its passive position or at least close to its passive position. A window 23 indicated in FIG. 2B represents a position tolerance range within which the braking element should be at a point in time e.g. of cut signal "CUT" 35 in FIG. 2F.

The weft now is cut. Yarn tension drops to curve section 17 in FIG. 2A representing the holding force generated by insertion nozzle N. Following curve section 24 in FIG. 2B braking element 5 now again moves to its braking position and pulls back the free yarn tip in insertion nozzle N. Shortly after signal 36 "OFF" for de-activating the deflection brake is generated, the current corresponding to curve section 29 in FIG. 2D is inverted to become negative to move the braking element in curve section 25 in FIG. 2B into its passive position. Earlier, i.e. during withdrawal of the weft yarn Y from storage drum 2, sensor 3 generates signals 30 shown in FIG. 2E on the basis of which the position of the weft yarn along its yarn path can be determined continuously. Signals 30 can be used to generate e.g. signals 32, 33, 35 and 36 at the correct points in time.

The actual positions of the braking element are determined at the points in time or time periods I–VIII as shown in FIG. 2C by means of said position detection means E in FIG. 1 and are compared to known, set target positions. Correction signals are derived from such comparisons if deviations occur. The functional parameters then are varied on the basis of said correction signals.

EXAMPLES

1. The target position at time I has to be between the passive position and the braking position. Detected passive position characterises a too late signal 32 "ON"; because, apparently the braking element could not reach the braking position in time. Signal 32 is adjusted to "earlier". Detected braking position at time I characterises a too early activation of the deflection brake and leads to an undesirable deceleration of the weft yarn flight. Signal 32 is adjusted to "later".

2. For a detection at time II a predetermined time period $\Delta t$ after time I the braking position is the target position. In case that the target braking position is not detected, this means a too late activation of the deflection brake. Signal 32 "ON" is adjusted to "earlier".

3. At time III, i.e. at the yarn tension peak in curve section 14, the braking element must no more remain in the braking position. In case that the braking position is detected, this indicates that the braking force is too high and that the braking element did not yield and damp. The current in curve section 27 is adjusted to a lower value. The braking force thus is decreased.

4. Within time period IV it is detected whether or not the braking element oscillates between the braking position and the passive position. If yes, the braking force (curve section 27 in FIG. 2D) was too low. By raising the current value in curve section 27 in 2D the braking force is increased.

5. At time V, i.e. at the occurrence of signal 33 in FIG. 2F, the braking element has to be in the braking position. If not, i.e. the detected actual position of the braking element is outside the braking position, the braking force was too low. The current corresponding to curve section 27 in FIG. 2D is increased and or the time for signal 33 is adjusted to "earlier", respectively.

6. At time VI upon occurrence of signal 35 "CUT" the target position of the braking element should be as close as possible to the passive position or at least within window 23 in FIG. 2B. In case that the detected actual position is outside of window 23, the current and in turn the braking force according to curve section 28 in FIG. 2D are reduced.

7. At time VII upon occurrence of signal 36 "OFF" the braking element has to be in the braking position. If no, i.e. the detected actual position is not the braking position, the current for curve section 28 in FIG. 2D is increased, until the braking force just is sufficient to pull back the free yarn tip counter of the holding force of curve section 17 in FIG. 2A. Expediently at VII, a detection is made over a time period to find out how the braking element then moves. The braking force in curve section 28 in FIG. 2D should only be as high as to just overcome the holding force. In case that the braking element reaches the braking position too rapidly, the braking force is decreased. In case of a too slow motion or when the braking element does not reach the braking position at all, the braking force is increased. In case that the holding force of the insertion nozzle N (by intention or for other reasons) varies then the current in curve section 28 is adapted to this varying condition.

8. At time VIII and a predetermined time period Δt after signal 36 for de-activating the deflection brake the braking element has to be in the passive position again. In case that the detected actual position is not the passive position consequently the return current corresponding to curve section 29 in FIG. 2D is increased.

The target positions and the selected times I to VIII are set in the setting section 10 beforehand. The functional parameters "activation of deflection brake and the respective braking force" first are set based on experience or experimental values. During operation of the insertion system a continuous adaptive adjustment of the functional parameters is carried out as explained above until the deflection brake has an optimum performance, i.e. the weft yarn flying time amounts to a minimum, energy is saved and the quota of yarn breakages remains low. This is advantageously carried out by a microprocessor operating with the program routine of FIG. 3.

Figure 3:
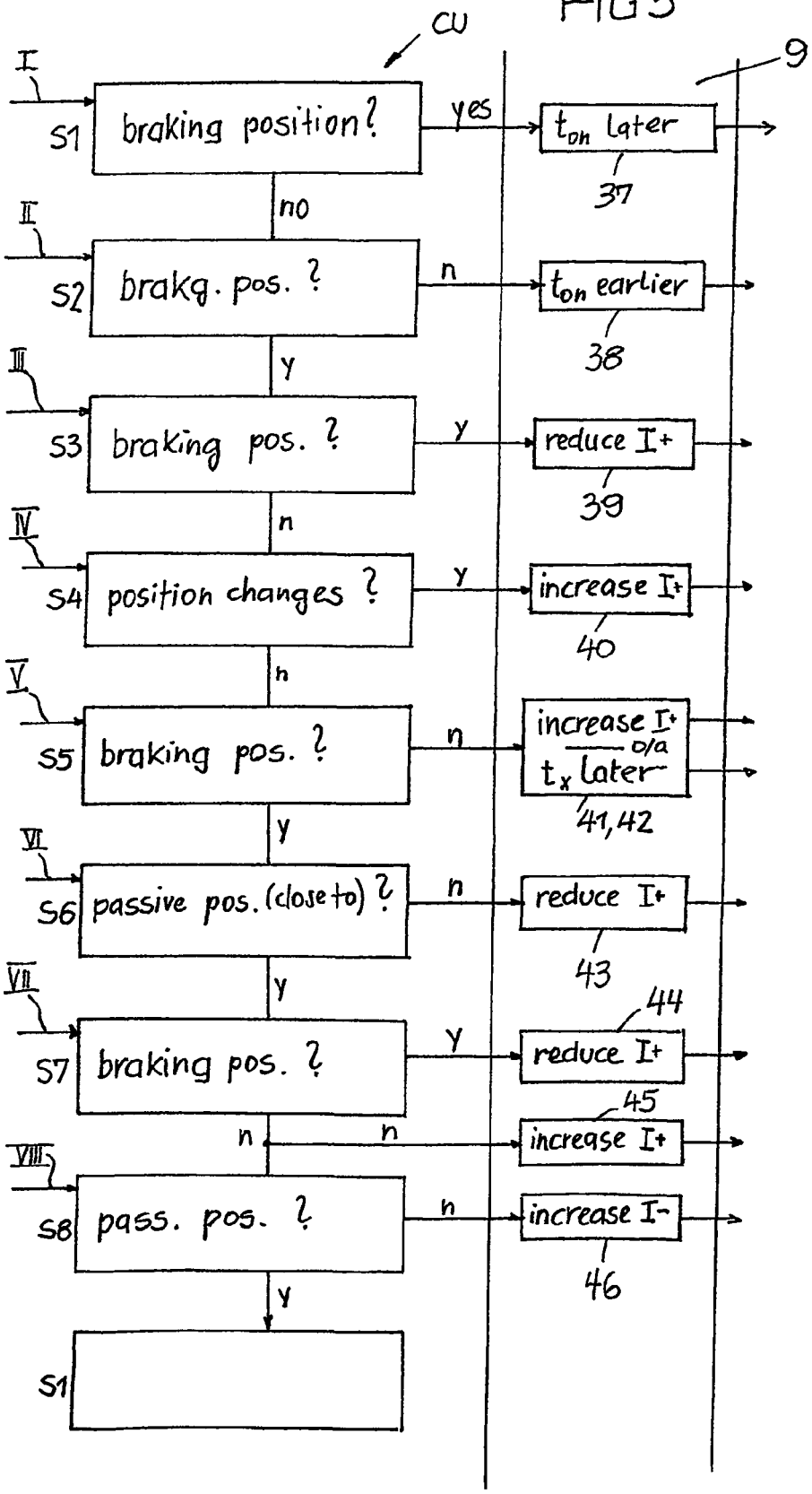
FIG. 3 is a flow chart depicting the process steps of an adaptive adjustment of functional parameters in the system of FIG. 1.

In FIG. 3, upon occurrence of signal 32 (activation of the deflection brake) in a step S1 it is detected whether or not the braking element has reached the braking position (too early). In case that the actual position is the braking position (yes), a command is output to an adjustment member 37 of adjustment device 9 to adjust the time for signal 32 to "later". In case that the braking element in step S1 has not reached the braking position (no), the flow continues to step S2 where it is checked the predetermined time duration Δt after signal 32 whether or not the braking element now (correctly) has reached the braking position. In case that this is not detected (n), a command is given to an adjustment member 38 to adjust the time for signal 32 to "earlier". In case that the braking element has reached the braking position (y), the flow continues to step S3 where it is checked at time III whether or not the braking element still is in the braking position. In case that the braking element holds (incorrectly) the braking position (y), a command is transmitted to an adjustment member 39 to reduce the braking force (the current in curve section 27). In case that the braking element has left the braking position (n), the flow continues to step S4 where it is checked whether or not abrupt position variations of the braking element occur. In case that such position variations are detected (y), a command is given to an adjustment member 40 to increase the braking force (the current in curve section 27). In case that the there are no detected position variations (n), the flow continues to step S5. In case that at step S5 at the time of signal 33 it is detected that the braking element has not yet reached the braking position (n), a command is transmitted to an adjustment member 41/42 either to increase the braking force and/or to adjust the time for signal 33 to "earlier". In case that the braking position is detected (y), the flow continues to step S6 where at the time of signal 35 it is checked whether or not the braking element is within window 23 of FIG. 2B. In case that the braking element is outside window 23 (n), a command is given to an adjustment member 43 to reduce the braking force (in curve section 28 in FIG. 2D). In case that the braking element is detected within window 23 or as close as possible to the passive position (y), the flow continues to step S7 where it is checked within the indicated time period how the braking element is moving into the braking position and whether or not it has reached the braking position at the time of signal 36. In case that the braking element has reached the braking position (y), a command is given to adjustment member 44 to reduce the braking force corresponding to curve section 28 in FIG. 2D. In case that the braking element has not reached the braking position (n), a command is given to an adjustment member 45 to increase the braking force. Then the flow continues to step S8 where a predetermined time period Δt after the occurrence of signal 36 in FIG. 2F it is checked whether or not the braking element again has reached the passive position. In case that the braking element has not yet reached the passive position (n), a command is given to an adjustment member 46 to increase the negative return current (in curve section 29 in FIG. 2D). In case that the passive position is detected (y), the flow continues into a standby condition to start at the next insertion by step S1.

What is claimed is:

1. Method for controlling the weft yarn insertion into a weaving machine, according to which method a deflection brake provided between a feeder and a weaving shed is brought into engagement with the weft yarn with an adjustable braking force in timed adaptation to at least parts of the insertion, said method comprising the steps of:

a. setting target positions of the brake beforehand for selected points in time within the time duration of an insertion, the target positions correlating with at least one functional parameter of the brake which is optimal for the weft yarn control at said points in time;

b. detecting the actual position of the brake during an insertion at a respective one of said selected points in time;

c. determining a deviation between said target position corresponding to said one point in time and said detected actual position of the brake and converting the deviation into a correction signal; and d. changing the functional parameter of the brake based on said correction signal for subsequent insertions until, at a subsequent detection of the actual position of the brake during a subsequent insertion, the actual position of the brake at least substantially coincides with the target position.

2. Method as in claim 1 wherein said step of changing the functional parameter comprises changing the point in time of the brake actuation and/or the value of the braking force applied by the brake.

3. Method as in claim 1 wherein during an insertion the actual position of said brake is detected and the comparison with the target position is carried out at said selected points in time and with the help of yarn winding passing signals originating from a sensor of the feeder and representing the progress of the insertion.

4. Method as in claim 1 wherein one of said selected points in time corresponds to a weft yarn cutting signal, and during the insertion at the occurrence of said cutting signal the actual position of the brake is detected and is compared with the target position.

5. Method as in claim 1 wherein a response behavior of the brake to its activating and/or deactivating signals is considered for the changing of said functional parameter.

6. Method as in claim 1 wherein, as a consequence of a detected actual position of the brake at the point in time of a yarn tension peak caused by the activation of a stopping device of the feeder shortly prior to the end of the insertion, the braking force is decreased.

7. Method as in claim 1 wherein, as a consequence of detected actual position changeovers of the brake between a braking position and a passive position at the point in time of a yarn tension peak caused by the actuation of a stopping device of the feeder shortly prior to the end of insertion, the braking force is increased.

8. Method as in claim 1 wherein, as a consequence of a detected actual position of the brake differing from the target position at a point in time of a yarn tension peak caused by the actuation of a stopping device of said feeder, the point in time for actuating the brake is adjusted to an earlier point in time.

9. Method as in claim 1 wherein, with an actual braking position of the brake detected a predetermined time interval prior to the point in time of a yarn tension peak caused by the actuation of a stopping device of the feeder, the point in time for actuating the brake is adjusted to a later point in time.

10. Method as in claim 1 wherein, with an actual position of the brake detected at a point in time of the weft cutting signal outside of a target passive position, optionally outside of a limited passive position tolerance range, the braking force is decreased.

11. Method as in claim 1 wherein, in dependence from whether the brake under the holding force in the cut weft yarn reaches the target braking position too rapidly or not at all after the point in time of a weft yarn cutting signal, the braking force is decreased or increased, respectively, to a just-necessary holding minimum value.

12. A method for controlling insertion of a weft yarn into a weaving machine wherein a deflection brake is provided between a feeder and a weaving shed of the weaving machine, the brake being movable into engagement with the weft yarn to apply a braking force thereto, said method comprising the steps of:

setting respective target positions of the brake corresponding to the selected respective points in time of an insertion cycle of the weaving machine, the target positions correlating with at least one functional parameter of the brake which is optimal for controlling the weft yarn at the respective points in time;

detecting the actual position of the brake during a first insertion cycle at a respective one of the points in time;

determining a deviation between the target position corresponding to said one point in time and the detected actual position of the brake at said one point in time;

converting the deviation into a correction signal; and changing the functional parameter of the brake based upon the correction signal such that the change takes effect at said one point in time occurring during a second insertion cycle occurring subsequent to said first insertion cycle.

13. The method of claim 12 wherein said step of changing the functional parameter comprises changing the point in time of actuation of the brake and/or changing the amount of braking force applied by the brake.

14. The method of claim 13 wherein said step of changing the functional parameter comprises changing the point in time of actuation of the brake, one of said target position of said brake corresponding to a point in time of a yarn tension peak occurring during an insertion cycle and caused by actuation of a yarn-stopping device of the feeder, said method further comprising changing the point in time of actuation of the brake to an earlier point in time based upon a detected deviation between said one target position and the detected actual position of the brake at the point in time corresponding to the yarn tension peak.

15. The method of claim 13, wherein said step of changing the functional parameter comprises changing the point in time of actuation of the brake, one of said target positions of said brake corresponding to a point in time of a yarn tension peak occurring during an insertion cycle and caused by an actuation of a yarn-stopping device of the feeder, said method further comprising changing the point in time of actuation of the brake to a later point in time based upon a detected actual braking position of the brake detected a predetermined time interval prior to the point in time corresponding to the yarn tension peak.

16. The method of claim 12 wherein said step of changing the functional parameter comprises changing the amount of the braking force applied by the brake, one of said target positions of said brake corresponding to a point in time of a yarn tension peak occurring during an insertion cycle and caused by actuation of a yarn-stopping device of the feeder, said method further comprising decreasing the amount of the braking force based upon a detected actual braking position of the brake detected at the point in time corresponding to the yarn tension peak.

17. The method of claim 12 wherein said step of changing the functional parameter comprises changing the amount of the braking force applied by the brake, one of said target positions of said brake corresponding to a point in time of a yarn tension peak occurring during an insertion cycle and caused by actuation of a yarn-stopping device of the feeder, said method further comprising increasing the braking force based upon detected actual position changeovers of the brake between a braking position and a passive position at the point in time corresponding to the yarn tension peak

18. The method of claim 12 wherein said step of changing the functional parameter comprises changing the amount of the braking force applied by the brake, one of said target positions of said brake corresponding to a point in time of a weft yarn cutting signal, said method further comprising decreasing the amount of braking force based upon a deviation between said one target position and the detected actual position of the brake at the point in time corresponding to the weft yarn cutting signal, said detected actual position being outside of a target passive position.

19. The method of claim 12 wherein said step of changing the functional parameter comprises changing the amount of the braking force applied by the brake, said method further comprising increasing the amount of braking force to a minimum holding value if the brake reaches a target braking position too slowly or not at all after a point in time corresponding to a weft yarn cutting signal, and decreasing the amount of braking force to a minimum holding value if the brake reaches a target braking position too rapidly after a point in time corresponding to a weft yarn cutting signal.

* * * * *